US005158065A

United States Patent [19]

Lee et al.

[11] Patent Number: 5,158,065

[45] Date of Patent: Oct. 27, 1992

[54] COOLING BACKGUARD ON UPSWEPT GAS COOK TOP

[75] Inventors: Duane A. Lee; Robert McFarland, both of Springfield, Tenn.

[73] Assignee: White Consolidated Industries, Inc., Cleveland, Ohio

[21] Appl. No.: 656,735

[22] Filed: Feb. 19, 1991

[51] Int. Cl.[5] ..... F24C 5/10

[52] U.S. Cl. ..... 126/21 R; 126/39 R; 126/214 R

[58] Field of Search ..... 126/21 R, 1 E, 39 R, 126/37 A, 211, 214 R, 214 A; 219/393, 396, 397, 398, 400

[56] References Cited

U.S. PATENT DOCUMENTS

| | | | |
|---|---|---|---|
| 2,743,719 | 5/1956 | Reeves | 126/21 R |
| 3,057,341 | 10/1962 | Perl | 126/21 R X |
| 3,063,441 | 11/1962 | Stoligrosz | 126/21 A |
| 3,499,430 | 3/1970 | Kemp | 126/21 R |
| 3,499,431 | 3/1970 | McArthur, Jr. | 126/39 R |
| 3,859,499 | 1/1975 | Evans et al. | 219/396 |
| 4,108,139 | 8/1978 | Gillion et al. | 219/400 X |
| 4,240,397 | 12/1980 | Seidel | 126/21 R |
| 4,598,691 | 7/1986 | Herrelko et al. | 126/21 R X |
| 4,869,231 | 9/1989 | Rice et al. | 126/214 R |

FOREIGN PATENT DOCUMENTS

| | | | |
|---|---|---|---|
| 881877 | 9/1971 | Canada | 126/21 A |
| 3246333 | 6/1989 | Fed. Rep. of Germany | 126/21 R |

*Primary Examiner*—Carl D. Price

*Attorney, Agent, or Firm*—Pearne, Gordon, McCoy & Granger

[57] ABSTRACT

A domestic cooking range provides an upswept cook top which promotes ease of cleaning in combination with a vent stack which exhausts flue gases from the oven through an elongated opening between the upswept portion and a control panel on the backguard. A deflector is provided to prevent the flue gases from impinging upon either the control panel or the cook top.

4 Claims, 3 Drawing Sheets

COOLING BACKGUARD ON UPSWEPT GAS COOK TOP

BACKGROUND OF THE INVENTION

This invention relates generally to cooking ranges, and more particularly to a gas range having a novel and improved upswept cook top and vent structure.

PRIOR ART

Upswept cook tops have been provided on electric ranges to promote ease of cleaning. Such upswept portion along the rear of the cook top eliminates the previously existing joint along the rear of the cooking surface at substantially the same level as the cooking surface. Since such joint has been at the level of the cook top, spills and the like tended to cause dirt to collect in the joint which has been difficult to clean.

By providing an upswept back in the cook top, this low level joint, with its dirt collecting problems, was eliminated. Since electric ranges do not require venting of combustion products, it has been common practice to vent the oven through one of the burners. Therefore, the provision of an upswept cook top in electric ranges did not raise any venting problems.

In gas ranges, however, it is necessary to vent the combustion products produced by the oven burners. In the past, the vents have provided exhaust openings immediately above the cook top at the center back portion thereof. At such location, the exhaust opening tends to be spaced a substantial distance below the control panel in the backguard of the range. Therefore, controls located in the backguard control panel did not become excessively heated by the vented flue gases.

U.S. Pat. No. 4,869,231 describes a domestic gas range having an upswept cook top that extends up into engagement with the lower side of the control panel in the backguard. Such patent indicates that flue gases are exhausted through a vent extending behind the upswept portion of the cook top, but does not illustrate or otherwise describe the vent system.

Other patents, such as U.S. Pat. Nos. 3,499,431; 4,240,397; and 4,598,691, describe gas ranges without an upswept cook top in which the flue gases are vented between the cook top and the control panel of the backguard.

SUMMARY OF THE INVENTION

The present invention provides a gas range having an upswept cook top and also providing a flue gas vent system in which the flue gases are exhausted through a narrow, elongated opening between the upswept portion of the cook top and the control panel in the backguard. The vent is configured so that the flue gases are deflected and pass through the opening with sufficient velocity and direction of flow so that the flue gases do not impinge on the control panel or the cook top. Also, the flue gases diffuse and mix with the ambient air to immediately reduce the temperature thereof. The velocity of the flue gases flowing through the opening is sufficient to propel them beyond the face of the control panel and the control panel in the backguard is not excessively heated.

Three embodiments of this invention are illustrated. In the first embodiment, the vent is provided with a hood which deflects the flue gases forwardly and downwardly as they pass through the elongated, narrow opening between the control panel and the upswept portion of the cook top. By establishing a downward component to the movement of the gases as they are discharged, the flue gases are diverted away from the control panel, preventing excessive heating of the control panel even during self-cleaning operations in which the temperature of the flue gases is very high.

A second illustrated embodiment provides a depending projection on the lower side of the control panel which deflects the flue gases downwardly away from the control panel as they exit from the vent. This structure again permits safe exhaust of flue gases even during self-cleaning operations.

In a third embodiment, the vent again discharges through a narrow opening between the control panel and the upswept portion of the cook top. In such embodiment, a relatively smooth deflector extends forwardly from the rearward side of the vent and along the lower side of the control panel. Such deflector again causes the flue gases to pass clear of the control panel and prevents excessive temperatures therein.

In each embodiment, a gas range is provided having an upswept cook top for ease of cleaning combined with a vent system which operates to vent the flue gases without producing excessive temperatures in the control panel located in the backguard.

These and other aspects of the invention are illustrated in the accompanying drawings and are more fully described in the following specification.

DETAILED DESCRIPTION OF THE DRAWINGS

Figure 1:
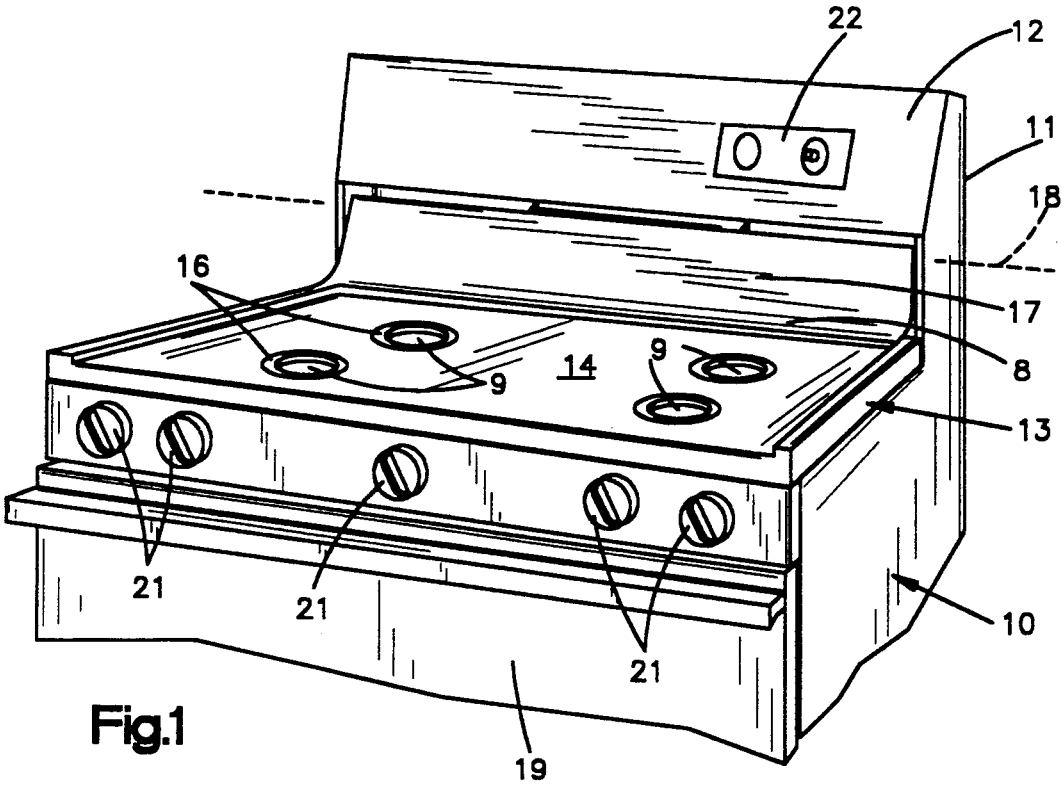
FIG. 1 is a perspective view of a range providing an upswept cook top and vent system incorporating the present invention.

FIG. 1 illustrates a typical domestic gas range including a frame 10 providing a backguard 11 with a control panel 12 therein. A cook top 13 provides a cooking surface 14 having openings 16 through which surface burners 9 project when the cook top is in the lowered position illustrated. Integrally formed along the back of the cook top 13 is an upswept portion 17 which joins the cooking surface with a relatively smooth blending radius 8. This eliminates the joint normally existing at the rearward edge of the cooking surface which tended to accumulate spills, boilovers, and other dirt, and which presented a severe cleaning problem in many instances.

The cook top 13 is pivoted for movement around a pivot axis 18 between the lowered illustrated position and a raised position in which access is provided below the cook top and around the burners for cleaning purposes.

An oven door 19 is pivotally mounted on the frame by a pivot system (not illustrated) and burner and oven controls 21 are typically mounted in the forward face of the frame above the oven door 19. Further, a timer and clock control 22 is mounted in the control panel 12 of the backguard.

Figure 2:
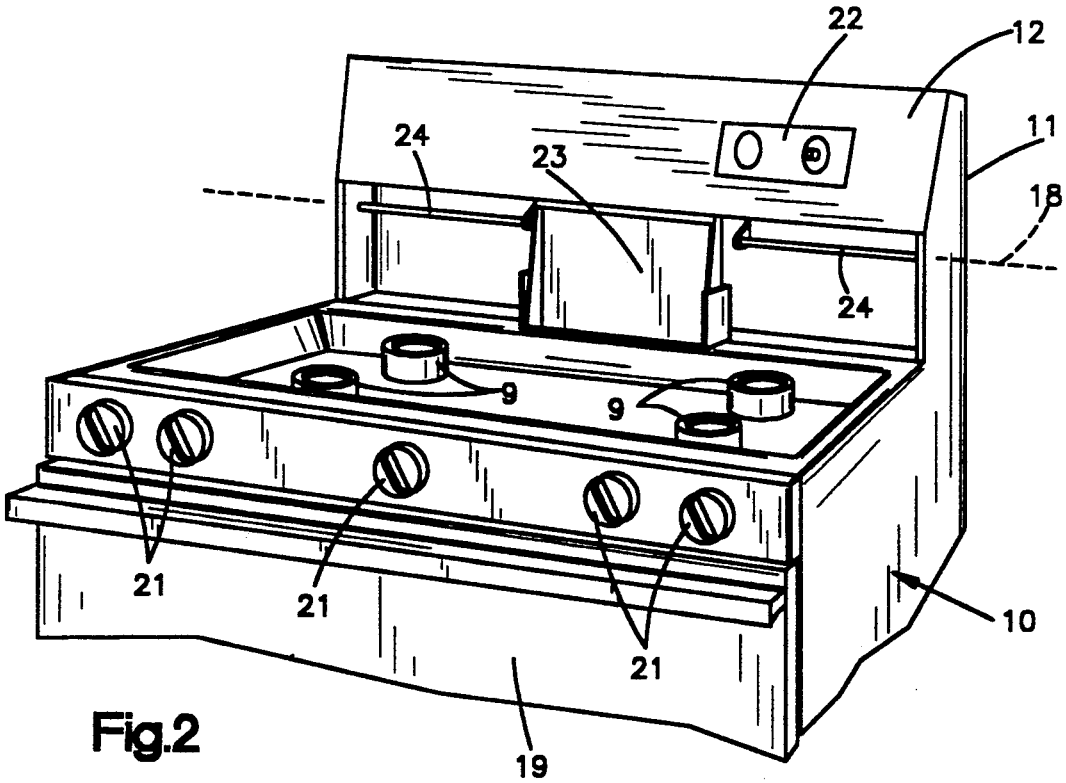
FIG. 2 is a perspective view similar to FIG. 1, with the cook top removed to illustrate the location of the vent.

FIG. 2 illustrates the range with the cook top 13 removed so that the oven vent stack 23 is clearly visible. The vent stack 23, described in detail below, extends a relatively short distance across the back of the range and is centrally located with respect to the backguard. As illustrated in FIG. 2, a pivot shaft 24 is provided on each side of the vent stack to pivotally support the cook top 13 for pivotal movement around the pivot axis 18.

Figure 3:
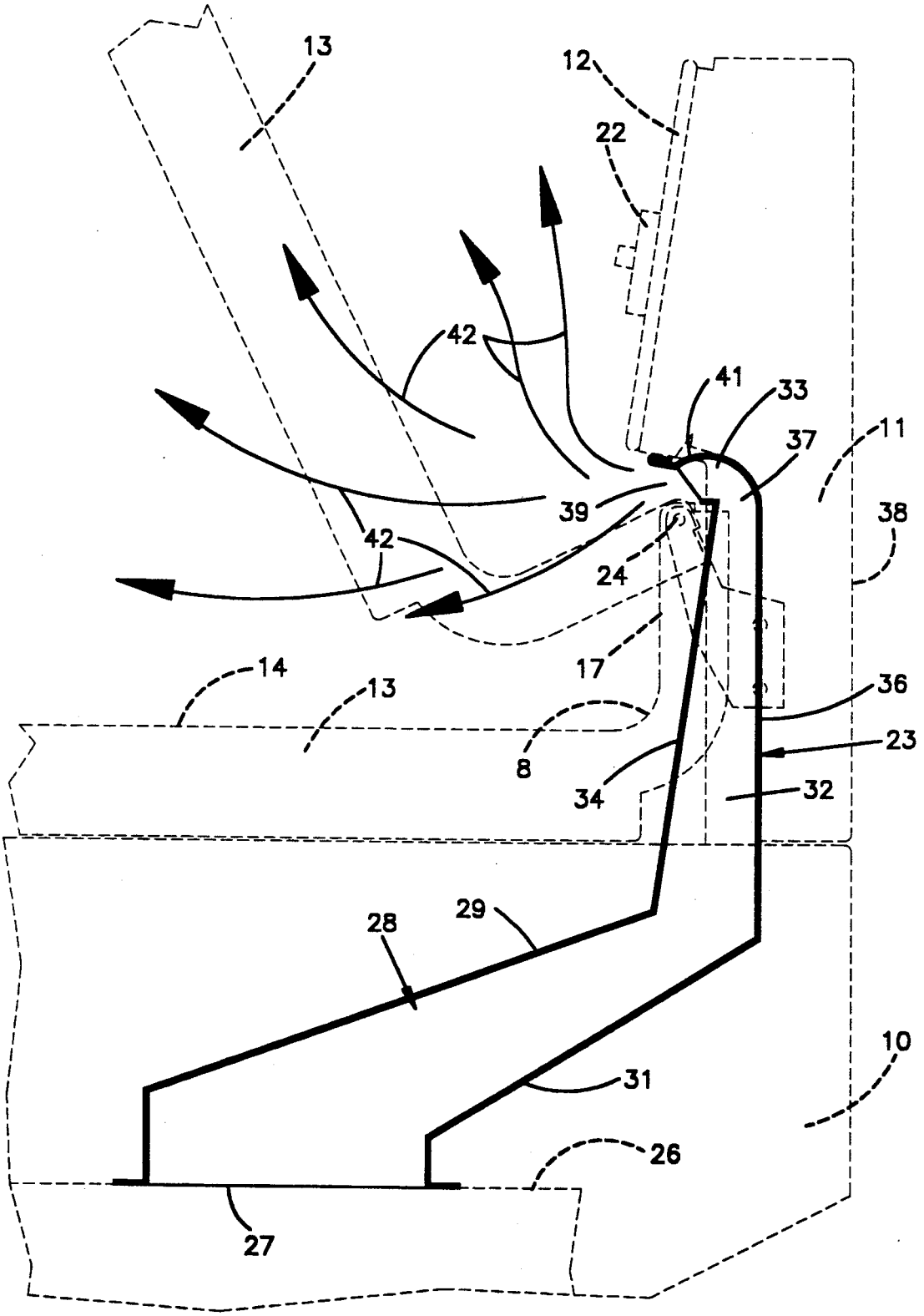
FIG. 3 is a schematic vertical section illustrating a first embodiment of this invention in which the vent is provided with a curved hood which causes the flue gases to exhaust in a downwardly inclined forward direction.

FIG. 3 is a schematic, vertical section of the first embodiment of this invention illustrated in FIGS. 1 and 2. Located within the frame 10, beneath the cook top 13, is a schematically illustrated self-cleaning gas oven 26. The vent stack 23 is open at its lower end 27 to the interior of the oven 26.

The vent stack provides an upwardly and rearwardly inclined portion 28 defined in part by upper and lower walls 29 and 31, respectively. These walls converge as they extend rearwardly. From the portion 28, the vent stack provides a substantially vertical portion 32 extending up behind the face of the upswept cook top portion 17 to a curved hood portion 33. The vertical portion 32 is defined in part by front and back walls 34 and 36, respectively, which converge in an upward direction and join with the hood portion through a relatively narrow throat 37. The converging walls result in a gradually decreasing cross section and cause the rate of flow of the flue gases to increase as they move to the throat. This produces sufficient flue gas velocity to cause the exhausting flue gases to move clear of the control panel.

The vent stack is spaced from and is not in contact with either the adjacent portions of the cook top 13 or the rearward wall 38 of the frame. This minimizes any heat transfer directly from the stack to the remaining portions of the range.

The curved hood portion 33 extends into a narrow, elongated opening 39 between the lower edge of the control panel and the upper edge of the upswept portion. This relatively narrow space 39 is provided for the exhaust of the flue gases passing up through the vent stack 23. The forward upper wall 41 of the curved hood portion extends downwardly at a sufficient angle so as to produce a downward component in the direction of flow of the flue gases passing out through the opening 39. Further, since the throat 37 of the vent stack is relatively narrow, the flue gases passing out through the vent stack are discharged with sufficient velocity to cause the flue gases to project outwardly in front of the control panel 12 so that the control panel is not excessively heated.

FIG. 3 illustrates diagrammatically by arrows 42 the pattern of flow of the flue gases passing out of the vent stack. These flue gases mix quickly with environmental air and are thereby substantially cooled by such mixing. Further, since the opening 39 is substantially above the cooking surface 14 of the cook top, the flue gases do not directly impinge upon the cook top surface and such surface is not excessively heated. With this vent stack structure, in which the flue gases are discharged with sufficient velocity to carry them away from the adjacent surfaces of the range, satisfactory temperatures can be maintained even in a self-cleaning gas oven. By providing the converging walls in the vent stack, relatively high velocities are achieved at the throat 37.

Figure 4:
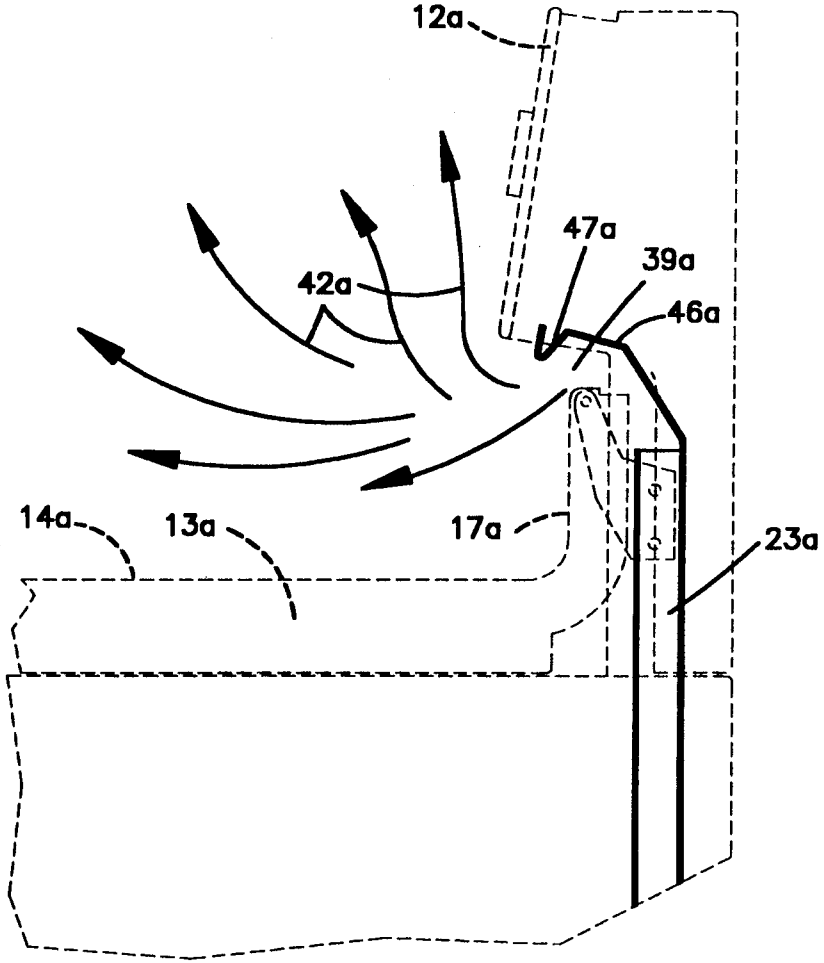
FIG. 4 is a vertical section of a second embodiment of this invention in which a depending projection is formed in the lower surface of the control panel.

FIG. 4 illustrates another embodiment of this invention. In this embodiment, similar reference numerals are used to designate elements corresponding to the elements of the first embodiment. However, an "a" is added to indicate reference to the second embodiment. The vent stack **23*a* again projects upwardly behind the upswept portion 17*a* of the cook top 13*a*. Here again, the upper end of the vent stack 23*a* is provided with a nozzle portion having a relatively small cross section so that the velocity of the gases flowing out of the vent stack is sufficient to project them forward and clear of the control panel 12*a* in the manner indicated by the arrows 42*a***.

In this instance, a deflector **46*a* is provided at the upper end of the vent stack 23*a*. The deflector provides a depending projection 47*a* which assists in deflecting the flue gases downwardly as they exit from the space 39*a* between the upper edge of the upswept portion 17*a* and the lower edge of the control panel. Here again, because the opening is substantially spaced above the cook top cooking surface 14*a***, such cook top surface is not excessively heated even though the flue gases are deflected in a downward direction as they exit through the opening.

Figure 5:
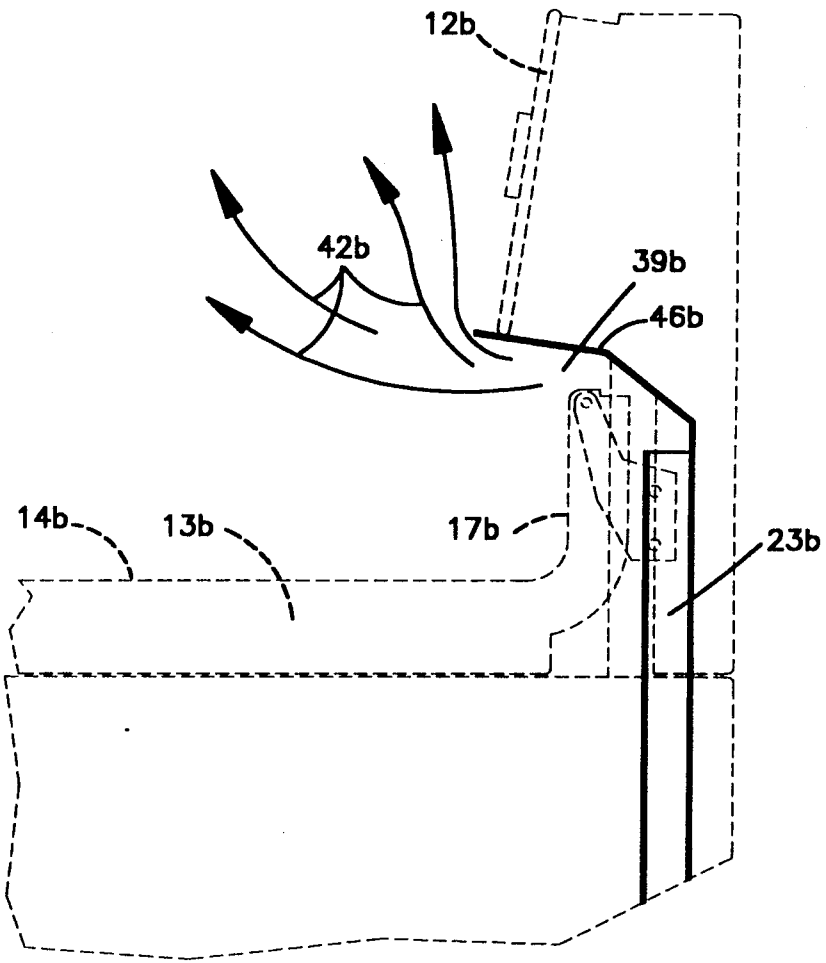
FIG. 5 is a vertical cross section of a third embodiment of this invention, in which a deflector extends forwardly from the rearward side of the vent and along the underside of the control panel to deflect the flue gases in a forward direction as they exhaust from the vent system.

FIG. 5 illustrates an embodiment which is similar to FIG. 4 except that it does not provide a projection **47*a* in the deflector portion 46*b* extending forwardly through the opening 39*b* from the rearward wall of the vent stack 23*b* at its nozzle. In this instance, the flue gases are not deflected downwardly as they exhaust through the opening 39*b*, but have sufficient velocity so that they are carried forwardly clear of the control panel 12*b*, as indicated by the arrows 42*b*. Again, an upswept portion 17*b* is provided so that the cooking surface 14*b* of the cook top 13*b*** can be easily cleaned.

In each of the embodiments, the forward lower edge of the control panel extends forwardly past the forward upper edge of the upswept portion of the cook top. However, since the vent stack and its exhaust ducting are arranged to provide sufficient discharge velocity and flow direction of the flue gases, the flue gases are projected out into the open above the range where they quickly mix with the environmental air and their temperatures are greatly reduced. In each instance, the discharge is substantially adjacent to the lower edge of the control panel, but the pattern of flow is such that the control panel is not excessively heated.

Although the preferred embodiments of this invention have been shown and described, it should be understood that various modifications and rearrangements of the parts may be resorted to without departing from the scope of the invention as disclosed and claimed herein.

What is claimed is:

1. A cooking range comprising a frame, a gas oven in said frame, a cook top on said frame providing a cooking surface, said cook top having front, rear, right and left side portions, surface burners projecting through said cooking surface, a backguard providing a control panel, a lower side of said backguard is substantially spaced above said cooking surface, said rear side portion of said cook top providing a portion extending smoothly from said cooking surface to an upper edge located substantially adjacent to and spaced from the lower side of said control panel, said upswept portion being devoid of debris collecting corners adjacent to said cooking surface, said upswept portion and said lower side of said control panel cooperating to define an elongated narrow opening extending laterally of said range at least along a center portion of said range substantially spaced from the right and left side portions of said cook top, a flue stack having a lower end open to said oven and providing a throat at its upper end adjacent said central portion of said elongated opening, and a deflector extending through said central portion of said elongated opening at first end and connected to the upper end of the throat at a second end to deflect exhaust gases from said upper end of said throat through said central portion of said elongated opening, said throat having a sufficiently small area to cause said flue gases to exhaust through said central portion of said elongated opening with sufficient velocity to flow forwardly beyond said control panel and prevent damaging heating of said control panel, and pivots locate to each side of said flue stack pivotally supporting said cook top for pivotal movement about a pivot axis substantially adjacent to said upper edge, said deflector dimensioned to said flue gases exhausting through said central portion of said elongated opening without impinging on either of said cooking surface and said control panel, said flue stack extending from said lower end to said throat with gradually reducing cross-section causing said flue gases to accelerate as they pass through said vent stack, said vent stack being spaced behind said upswept portion.

2. A cooking range as set forth in claim 1 wherein said oven is a self-cleaning gas oven.

3. A cooking range as set forth in claim 2, wherein said deflector provides a depending portion operable to deflect said flue gases in a downwardly inclined direction as they exhaust from said elongated opening, said opening being of sufficient height above said cooking surface to prevent said flue gases from impinging on said cooking surface.

4. A cooking range as set forth in claim 3, wherein said deflector is a curved hood, said hood providing said depending portion.

* * * * *